United States Patent [19]

Kempel et al.

[11] 4,379,480

[45] Apr. 12, 1983

[54] ENERGY EFFICIENT GARAGE DOOR CONSTRUCTION AND THE LIKE

[75] Inventors: John J. Kempel; Ronald F. Otto, both of West Branch, Mich.

[73] Assignee: Garland Manufacturing Company, Detroit, Mich.

[21] Appl. No.: 168,537

[22] Filed: Jul. 14, 1980

[51] Int. Cl.[3] ..... E06B 3/12; E06B 9/00

[52] U.S. Cl. ..... 160/232; 160/201; 52/809; 52/309.9

[58] Field of Search ..... 52/309.9, 309.11, 403, 52/580, 802, 809, 795, 804, 821; 160/232, 201, 228, 229 R, 209, 40; 49/501, 503

[56] References Cited

U.S. PATENT DOCUMENTS

| | | | |
|---|---|---|---|
| 2,893,067 | 7/1959 | Meek | 52/804 |
| 3,178,776 | 4/1965 | Stansberry | 160/229 R |
| 3,313,073 | 4/1967 | Mathews | 52/309.2 |
| 3,512,304 | 5/1970 | Meuret | 49/478 |
| 3,529,389 | 9/1970 | Wilkins | 52/809 |
| 3,830,027 | 8/1974 | Paisley | 52/802 |
| 3,967,671 | 7/1976 | Stanley et al. | 160/232 |
| 4,183,393 | 1/1980 | Bailey | 160/232 |
| 4,186,539 | 2/1980 | Harmon | 52/580 |

FOREIGN PATENT DOCUMENTS

| | | | |
|---|---|---|---|
| 216084 | 10/1967 | Sweden | 160/232 |
| 409329 | 10/1966 | Switzerland | 160/232 |
| 332093 | 7/1930 | United Kingdom | 160/40 X |

*Primary Examiner*—Peter M. Caun
*Assistant Examiner*—Cherney S. Lieberman
*Attorney, Agent, or Firm*—Harness, Dickey & Pierce

[57] ABSTRACT

An energy efficient garage door construction comprising a plurality of interconnected door sections. Each of the sections includes a pair of symmetrical metal panels forming the opposed sides and long edges of the section, an expanded polystyrene core to which the metal panels are adhesively bonded, and a pair of generally U-shaped end pieces nestingly received between the metal panels. The metal panels form oppositely facing recesses along one side edge and tongues along the other side edge so that adjacent panels interfit to create a baffle effect, and the panels are held together by C-shaped retaining plates which serve the secondary function of hinge reinforcement members.

1 Claim, 10 Drawing Figures

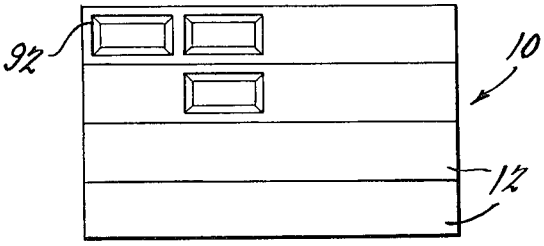
FIG. 1.
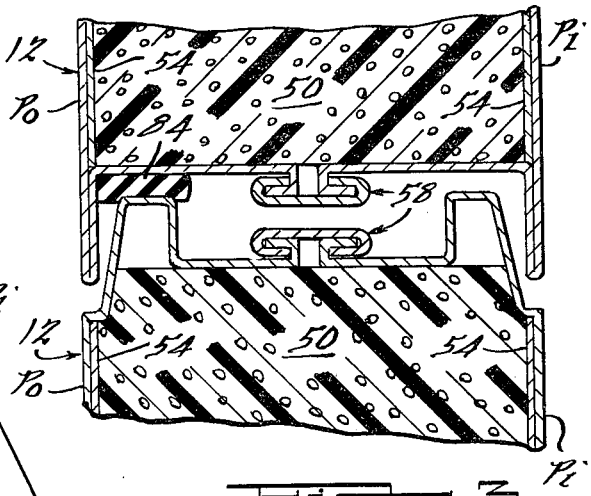
FIG. 3.
FIG. 2.
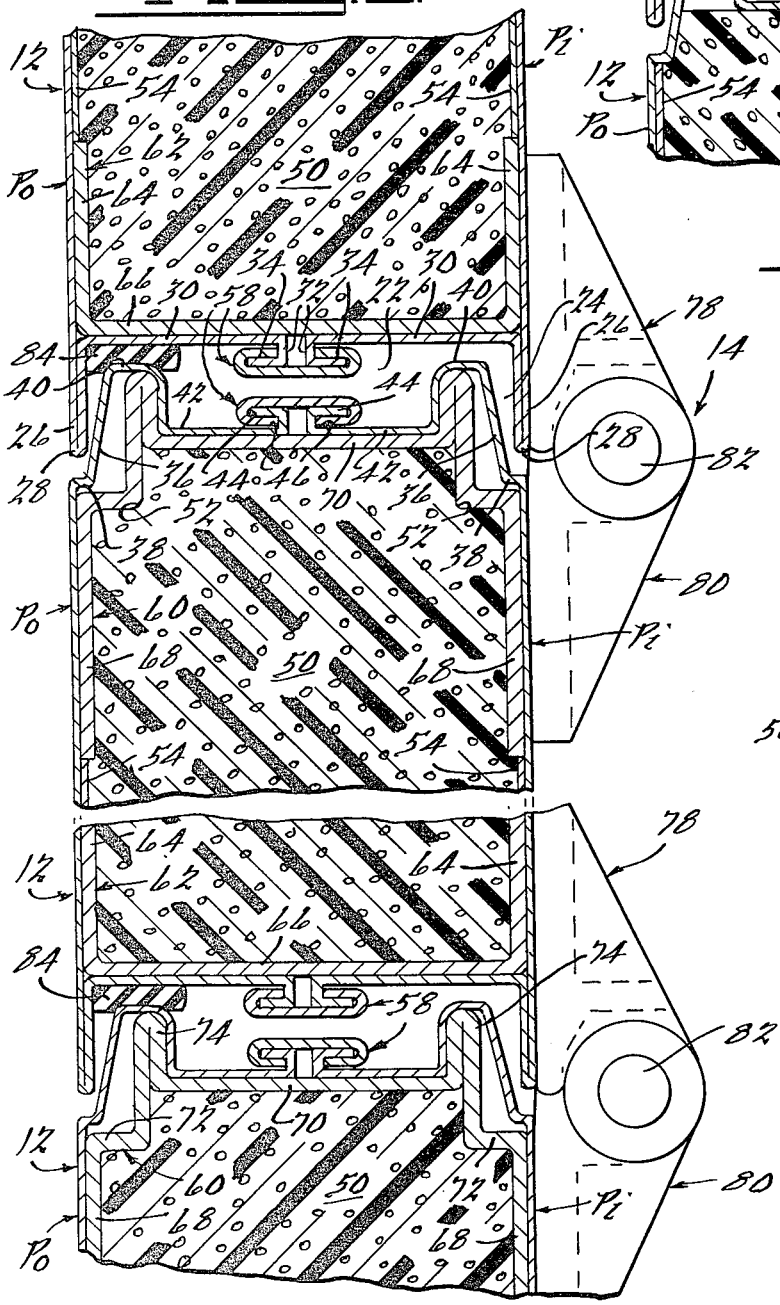
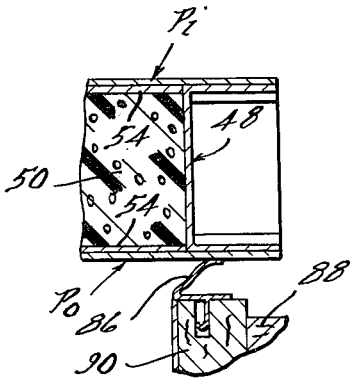
FIG. 4.

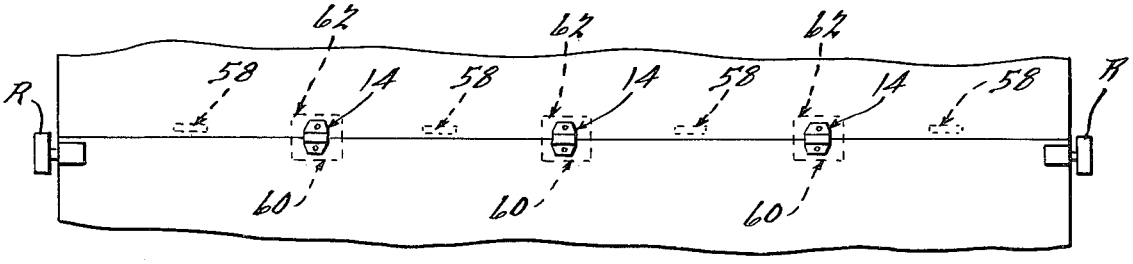
FIG. 5.
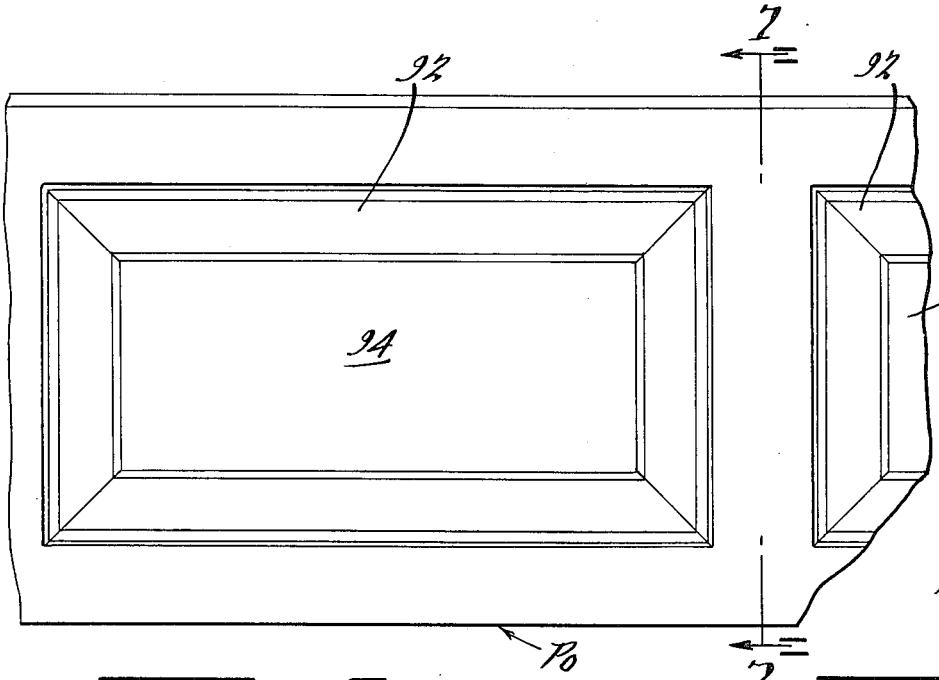
FIG. 6.
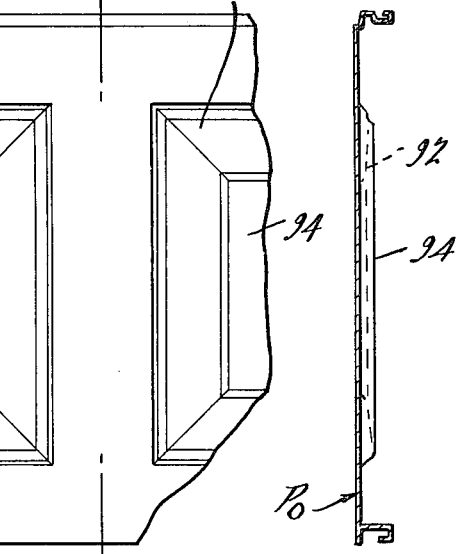
FIG. 7.
FIG. 8.
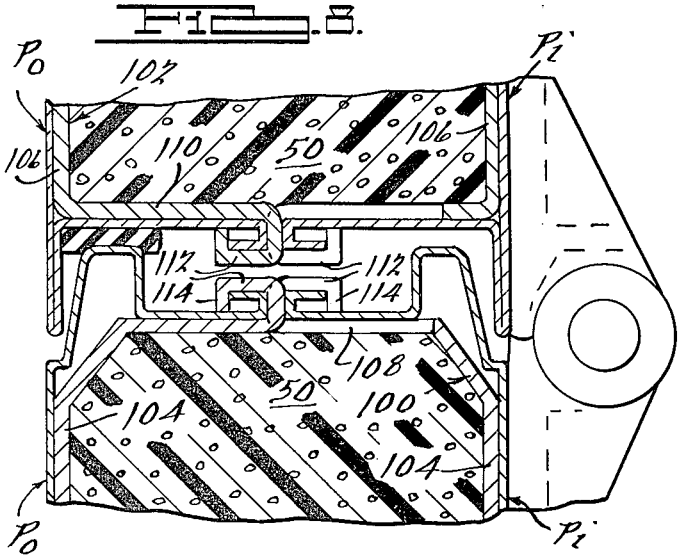
FIG. 9.
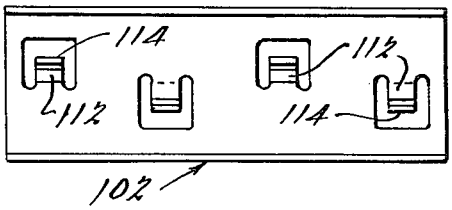
FIG. 10.
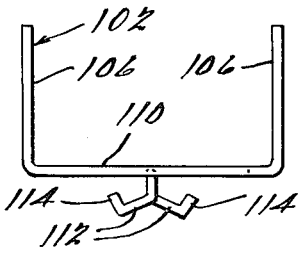

ENERGY EFFICIENT GARAGE DOOR CONSTRUCTION AND THE LIKE

BACKGROUND OF THE INVENTION

1. Field of the Invention

This invention relates generally to structural panels, and more particularly to laminated panels fabricated of sheet metal between which is disposed a core of an insulating media, such as expanded polystyrene. The invention is also concerned with panels which, when in adjacent relation, create a baffle effect and are thus useful in building constructions in general, and in particular, in sectional-type garage doors and the like.

2. Description of the Prior Art

It is old to construct interior doors with symmetrical metal jacket members on both sides bonded to a foam core. The side edges of such panels, however, are not constructed so that adjacent panels would create a baffle effect. Such panel constructions therefore are not suitable for such installations as sliding garage doors or building exteriors.

It has also heretofore been the practice to provide end members of U-shaped cross section for laminated structural panels of the aforesaid general nature. However, such conventional end members have flanges which overlap the two metal jacket members, with the web of the edge member being disposed exteriorly. When stacking such conventional panels for shipment, a slight gap will thus exist between the individual panel sections and the vibration during transportation may result in surface damage due to abrasion. Another disadvantage of this prior construction is that the faces of the panel are not continuous throughout their extent because of the presence of the exposed edge member flanges. Such prior end members are also not compatible with the optimum design of an interfitting baffle construction for the side edges of building panels.

The following prior art is related to the inventive concepts disclosed and claimed herein:

| Patent No. | Inventor | Issue Date |
|---|---|---|
| 2,258,810 | H. Rabezzana et al | Oct. 14, 1941 |
| 2,896,271 | G. E. Kloote et al | July 28, 1959 |
| 3,137,973 | L. H. Williams | June 23, 1964 |
| 3,153,817 | J. L. Pease, Jr. | Oct. 27, 1964 |
| 3,313,073 | H. G. Mathews | April 11, 1967 |
| 3,336,713 | Y. Privas | Aug. 22, 1967 |
| 3,353,318 | L. O. Bacher | Nov. 21, 1967 |
| 3,386,209 | L. J. Starcevic | June 4, 1968 |
| 3,527,283 | R. R. Butler et al | Sept. 8, 1970 |
| 3,535,844 | E. M. Glaros | Oct. 27, 1970 |
| 3,583,118 | W. E. Lowery | June 8, 1971 |
| 3,667,180 | W. Tischuk | June 6, 1972 |
| 3,714,747 | B. E. Curran | Feb. 6, 1973 |
| 3,715,846 | H. Sullhofer | Feb. 13, 1973 |
| 3,733,232 | H. J. W. Payne | May 15, 1973 |
| 3,760,548 | G. F. Sauer et al | Sept. 25, 1973 |
| 3,777,430 | W. Tischuk | Dec. 11, 1973 |
| 3,786,609 | J. Difazio | Jan. 22, 1974 |
| 3,786,613 | W. L. Shepheard | Jan. 22, 1974 |
| 3,815,657 | W. K. Malek et al | June 11, 1974 |
| 3,837,134 | J. DiFazio | Sept. 24, 1974 |
| 3,932,976 | J. F. Steel | Jan. 20, 1976 |
| 3,941,180 | T. N. Thill | Mar. 2, 1976 |
| 3,967,671 | R. W. Stanley et al | July 6, 1976 |
| 4,022,644 | H. S. Smith, Jr. | May 10, 1977 |
| 4,028,859 | P. Bellagamba | June 14, 1977 |
| 4,034,528 | S. J. Sanders et al | July 12, 1977 |
| 4,037,377 | N. C. Howell et al | July 26, 1977 |
| 4,100,710 | J. Kowallik | July 18, 1978 |
| 4,104,840 | D. R. Heintz et al | Aug. 8, 1978 |

-continued

| Patent No. | Inventor | Issue Date |
|---|---|---|
| 4,119,133 | C. R. Wolf | Oct. 10, 1978 |
| 4,140,824 | A. J. C. Gaillard | Feb. 20, 1979 |
| 4,156,448 | F. B. Bengtsson | May 29, 1979 |
| 4,183,393 | M. W. Bailey | Jan. 15, 1980 |

BRIEF SUMMARY OF THE INVENTION

It is a general object of the present invention to provide a new and improved energy efficient laminated building structure which not only utilizes symmetrical metal panel members bonded to a plastic core, but incorporates a baffle arrangement along the side edges thereof, thus enabling the structure to be utilized for such installations as sectional-type overhead garage doors and building exteriors.

It is another object of the present invention to provide a new and improved panel construction of the above character which has high rigidity and strength, eliminating the need for trusses to resist side pressure such as wind loads.

It is yet another object of the present invention to provide a new and improved panel-type building structure which comprises symmetrical inner and outer metal panels which reduce inventories, tooling costs and manufacturing time.

It is another object of the present invention to provide a new and improved laminated building structure wherein the outer and inner metal panels may be reversible so as to provide for universality of application, i.e., have one painted side and one woodgrain side, etc.

It is still another object of the present invention to provide a new and improved sectional-type garage door construction having highly improved aesthetic characteristics and which has improved acoustic attenuating characteristics.

It is still another object of the present invention to provide a new and improved panel construction for use in sectional-type garage doors wherein each door section is fabricated of a reduced number of parts, as compared to prior art designs, thereby providing for reduced installation costs.

It is still a further object of the present invention to provide a laminated door structure wherein the sheet metal inner and outer panels thereof may be fabricated of a reduced gauge (thickness) material without sacrificing the structural integrity and structural rigidity of the panel design.

It is yet another object of the present invention to provide a new and improved sectional-type garage door construction having an improved security characteristics by virtue of the fact that each door section comprises inner and outer metal members, both of which must be penetrated to gain access to the interior of the associated structure.

It is a further object of the present invention to provide a new and improved sectional-type garage door construction of the above character which has improved safety characteristics by virtue of the fact that there are no sharp edges to potentially injure people.

A further object of the present invention resides in the fact that the panels of each garage door may be easily replaced in the event of damage thereto.

It is still a further object of the present invention to provide a new and improved garage door construction of the above character wherein the hinge reinforcement members are disposed in a concealed position so as to not adversely affect the aesthetic appearance of the door.

It is a further object of the present invention to provide an improved laminated panel construction of this character which will not sag when utilized in sectional-type garage door installations.

It is yet another object of the present invention to provide a novel and improved panel construction of the above character which incorporates a thermal break in addition to the baffle arrangement, thus improving the insulative properties of a wall or garage door built with these units.

It is a further object to provide an improved panel construction as above described, which has a novel end member construction permitting panels to be stacked for transportation without gaps.

It is also an object to provide an improved end member construction for a laminated panel having metal jacket members, and which allows these jacket members to present continuous faces throughout their extent on both sides, and also facilitates the adaptation of the jacket members for a baffle effect between adjacent panels.

Other objects, features and advantages of the invention will be found in the following specification and claims as well as the accompanying drawings.

Briefly, the aforementioned objects are achieved with a laminated building structure comprising first and second elongated metal panel members of identical cross-sectional shape, a unitary expanded plastic core disposed between and adhesively bonded to said panel members, with each panel member having a main surface, a first side edge having a recessed portion adjacent said main surface and a connecting portion extending toward the other jacket member, the second side edge of each panel member comprising a tongue portion extending outwardly from said main portion and formed by doubling back the panel member, and a connecting portion extending from said tongue portion toward the other jacket membeer, said recessed portions being sufficiently deep relative to said tongue portions whereby the two tongue portions of each structual section will interfit with the two recessed portions of an adjacent section to create a baffle effect, as will hereinafter be described in detail.

BRIEF DESCRIPTION OF THE DRAWINGS

FIG. 1 is a side elevational view, with parts broken away, of a sectional-type garage door made up of door sections constructed in accordance with the present invention;

FIG. 2 is an enlarged fragmentary cross-sectional view, partially broken away, of a portion of the garage door illustrated in FIG. 1;

FIG. 3 is a cross-sectional view, similar to FIG. 2, of a portion of the garage door shown in FIG. 1, and in particular, a fragmentary portion of two door sections is illustrated to depict the baffle effect provided thereby;

FIG. 4 is a fragmentary cross-sectional view of the garage door of the present invention, as shown in operative association with a door jamb structure;

FIG. 5 is a fragmentary side elevational view of a portion of the garage door construction of the present invention illustrating the location of the hinge elements and associated reinforcement plates;

FIG. 6 is an enlarged fragmentary side elevational view of a portion of one of the panels incorporated in each of the garage door sections of a modified embodiment of the present invention and illustrates how the panels may be embossed for aesthetic purposes;

FIG. 7 is a transverse cross-sectional view taken substantially along the line 7—7 of FIG. 6;

FIG. 8 is an enlarged fragmentary cross-sectional view similar to FIG. 3 and illustrates a modified embodiment of the hinge reinforcement members incorporated in the present invention;

FIG. 9 is a plan view of one of the hinge reinforcement plates incorporated in the embodiment shown in FIG. 8; and FIG. 10 is a fragmentary cross-sectional view of a portion of one of the retaining fingers incorporated in the hinge reinforcement plates.

DESCRIPTION OF THE PREFERRED EMBODIMENTS

Referring now in detail to the drawings and in particular to FIG. 1 thereof, a garage door structure 10, in accordance with one preferred embodiment of the present invention, is shown generally as comprising a plurality of coplanar arranged, generally horizontally disposed door sections 12 which are hingedly or pivotably connected to one another by means of hinge assemblies 14 (best seen in FIG. 5). As will be appreciated by those skilled in the art, the door structure 10 is normally disposed in a generally vertical orientation and is supported upon a plurality of rollers which cooperate with a door track assembly, whereby the entire structure may be moved upwardly from the position shown in FIG. 1 to an elevated configuration providing access to the interior of an associated garage or the like. It is to be noted that while the principles of the present invention are described herein as being specifically applicable to the garage door structure 10, the panel construction embodied in the door structure 10 may also find application to various types of building walls known in the art as post construction or the like, such as is employed in shed building and auxiliary building constructions. Typically, the panels which are incorporated in the garage door structure 10 would be supported upon a suitable structural frame of such a building in a manner well known in the art. In such structures, it is often desired that the panels have substantial resistance to bending, for example, when subjected to high wind loading. It is also appropriate to have little or no sag in the panels when they are positioned horizontally, such as in the case with the garage door structure 10 depicted in FIG. 1. Another desirable feature is to provide a baffle effect between adjacent panels, that is, the provision of a nesting or interfitting relationship between adjacent panel edges which inhibits or prevents the passage of air therebetween. This baffle effect should not interfere with the ability of the respective sections to pivot or rock relative to one another, as is typically necessary in connection with sectional-type garage doors, such as the door structure 10. The panels should also be capable of stacking when shipping to provide for a minimum of noise and vibration, and finally, it is desirable that there be a minimum of heat conduction between the opposite faces or panels of each structural section so as to provide a "thermal break" and thereby minimize the transfer of heat therebetween. As will hereinafter be described in detail, all of these objectives are accomplished by the present invention which, as previously mentioned, will find application not only to the garage door structure 10 specifically discussed herein, but also to building panels of a similar or identical construction as applied to pre-existing building framework or the like.

Referring now to FIGS. 2 and 3, it will be seen that the lower horizontal edge of each of the door sections 12 defines a recessed area 22, and that the upper horizontal edge of each of the door sections 12 defines a tongue area 24, the areas 22, 24 being nestingly engageable with one another such that the tongue area 24 is insertable within the recessed area 22 for purposes hereinafter to be described. The recessed areas 22, 24, along with the exterior and interior sides of each of the door sections 12 are defined by a pair of panel members, hereinafter identified as $P_i$ and $P_o$ for the interior and exterior panel members, respectively. The members $P_i$ and $P_o$ are preferably fabricated of roll formed steel or sheet metal and in accordance with one of the principles of the present invention, are identical to one another. As will be appreciated by those skilled in the art, by having the panel members $P_i$ and $P_o$ of an identical construction, manufacturing costs, i.e., inventory costs, tooling, etc., is minimized to the extreme.

The recessed area 22 of each of the door sections 12 is defined by the lower horizontal edges of the panel members $P_i$ and $P_o$ which are formed with a downwardly projecting flange 26 defined by a return bend portion 28 that terminates in an inwardly projecting portion 30 that is arranged at generally right angles to the plane of the panels $P_i$ and $P_o$. The innermost terminal edge of the portion 30 is formed with a reverse bend portion 32 which defines a recess 34 which functions in a manner hereinafter to be described.

The tongue area 24 of each of the door sections 12 is defined by the uppermost horizontal edges of the respective panel members $P_i$ and $P_o$ and in particular, by having the upper horizontal edges laterally inwardly offset and inclined inwardly, as seen at 36, so as to define lateral shoulders 38. The inclined portions 36 of each of the panels $P_i$ and $P_o$ is formed with a U-shaped upper portion 40 which is connected to a laterally inwardly extending portion 42 that is arranged at generally right angles to the plane of the panels $P_i$ and $P_o$. As in the case with the portion 30, the inward terminal end of the portion 42 is formed with a reverse bend portion 44 defining a recess 46, for purposes hereinafter to be described.

FIG. 4 best discloses the provision of a pair of generally U-shaped end members that are provided at the opposite ends of each of the door sections 12. The end member representatively shown in FIG. 4 is identified by the numeral 48 and is identical to the end member at the opposite end of the associated door section 12. The end member(s) 48 is of a generally U-shaped construction, as previously mentioned, and comprises a central web in a pair of flange portions which are adapted to be secured, as by spot welding or the like, to the interior edges of the associated panels $P_i$ and $P_o$ so as to close the longitudinally opposite ends of the door section 12. By having the end members 48 disposed interiorly of the opposite ends of the door section 12, the exterior surfaces of the panels $P_i$ and $P_o$ are continuous, whereby the sections 12 may be stacked for transportation and will not be subject to vibration, etc., as will be appreciated by those skilled in the art.

Disposed between and laminated to the interior surfaces of the panels $P_i$ and $P_o$ is an internal core member, generally designated by the numeral 50. The core 50 is preferably fabricated of a material such as expanded polystyrene and is preferably of a one-piece monolythic body which is coextensive of the interior of each of the door sections 12. Preferably, the core member 50 is of a relatively uniform thickness and is of generally rectangular shape, with the exception of recessed portions 52 along the upper inner and outer edges thereof which accommodate hinge reinforcement members hereinafter to be described disposed interiorly of the panel members $P_i$ and $P_o$ at longitudinal spaced positions along the door sections 12 corresponding to the hinge assemblies 14. A layer of a suitable adhesive material, such as neoprene or a similar adhesive, as indicated at 54, is provided interjacent the opposite sides of the core member 50 and the confronting surfaces of the panels $P_i$ and $P_o$, the adhesive material 54 functioning to positively bond or laminate the panel members $P_i$ and $P_o$ and core member 50 into a rigid door section construction which will be found to be highly resistant to bending loads. Adhesive material 54 may be of a heat reactivated type which has been found to provide for optimum strength, and the polystyrene core material has been found to exhibit extremely beneficial heat insulating characteristics to minimize heat transfer through the door sections 12, as is well known in the art.

In accordance with one of the principles of the present invention, the upper and lower edges of the panels $P_i$ and $P_o$ are secured to one another by a plurality of longitudinally spaced, generally C-shaped retaining clips, generally designated by the numeral 58. In particular, and as best seen in FIGS. 2, 3 and 5, the clips 58, which may be fabricated of metal or plastic, are adapted to be surmounted upon the return bend portions 32 and 44 at the lower and upper edges of the panels $P_i$ and $P_o$ and have the terminal ends of the clips 58 received within the recesses 34 and 46, respectively. The clips 58 may be slid into position along the recesses 34, 46, and preferably the clips 58 are positioned longitudinally along the respective door sections 12 at the positions representatively shown in FIG. 5 wherein the clips 58 are disposed interjacent the hinge assemblies 14 and interjacent the edges of the door sections 12 and conventional garage door rollers located therealong and the outermost of the hinge assemblies 14. In accordance with one feature of the present invention, it is to be noted that when the upper and lower edges of the panels $P_i$ and $P_o$ are thus connected by the plurality of retaining clips 58, there is no actual contact between the adjacent edge portions of the panels $P_i$ and $P_o$, thereby providing a thermal break which minimizes to the extreme the conduction of heat between the panels $P_i$ and $P_o$.

Operatively associated with each of the hinge assemblies 14 is a pair of hinge reinforcement members, generally designated by the numerals 60 and 62, which are disposed within the upper and lower portions, respectively, of each of the door sections 12. As shown in FIG. 2, the lower hinge reinforcement member 62, comprises a pair of spaced parallel side sections 64 interconnected by a laterally extending base or web portion 66 and is adapted to be nestingly received interiorly of the door section exterior panels $P_i$ and $P_o$. Suitable securing means, such as an appropriate adhesive bonding material, is utilized for operatively securing the reinforcement member 62, as well as member 60, in place. With reference again to FIG. 2, it will be seen that the reinforcement member 60 associated with each of the members 62 is also of a generally C-shaped configuration and includes a pair of spaced parallel side portions 68 with a laterally interconnecting base or web portion 70 extending therebetween. In order to accommodate the laterally offset and inclined portions 36 and U-shaped bend portions 40 at the upper edges of each of the panels $P_i$ and $P_o$, the hinge reinforcement members 60 are provided with laterally inwardly extending shoulders 72 which are formed with upper reverse bend portions 74 that are integrally connected to the web portion 70, as illustrated.

Each of the hinge assemblies 14 comprises upper and lower pivotal hinge sections 78 and 80, respectively, which are fixedly secured by any suitable means, i.e., spot welding, sheet metal screws, bolts or the like, to the associated door sections 12, with the hinge sections 78, 80 of each of the assemblies 14 being pivotably connected by suitable hinge pins or pintles 82 in a manner well known in the art. As will be appreciated, the number of hinge assemblies 14 provided on the garage door structure 10 and in particular, interjacent each vertically adjacent pair of door sections 12 will depend upon the longitudinal length, i.e., width, of the particular door structure 10. Typically, on a 16 foot wide door, three hinge assemblies 14 and their associated hinge reinforcement members 60, 62 would be spaced longitudinally along the interconnection between each of the door sections 12, whereas on an 8 or 9 foot wide door structure 10, possibly only a single hinge assembly 14 would be utilized at the centerline of the door structure 10, with the outer marginal edges of the respective door sections 12 being interconnected by the conventional roller hinge mechanisms used and known in the art.

In accordance with one of the important features of the present invention and which contributes considerably to the energy effectiveness of the door structure 10 is the baffle effect provided by the operative relationship between the tongue area 24 at the upper longitudinal edge of each of the door sections 12 and the cooperative recessed or tongue receiving area 22 at the lower longitudinal edge of the next upwardly adjacent door section 12. The tongue and recessed areas 24, 22, respectively, function to prevent drafts from passing directly through the door structure 12 yet permit the articulated or hinged interconnection between the sections 12 as is necessary to accommodate the sliding movement of conventional sectional-type doors. In order to supplement the baffle effect provided by the tongue and recessed areas 24, 22, a suitable weather seal element 84 is interposed between each of the door sections 12, as is indicated in FIGS. 2 and 3. The weather seals 84 preferably extend the entire width of each of the door sections 12 and may be operatively secured to either the underside of the upwardly adjacent door section 12 or the upper side of the shaped bend portion 40 of the next lower adjacent door section 12. The weather seal 84 may be of any suitable construction, such as a suitable deformable or resilient polyolefin foam, having a pressure sensitive adhesive backing, as is well known in the art. A similar type sealing element 86 is preferably provided adjacent the longitudinally opposite edges of the door structure 10 and is adapted to sealingly engage the door structure 10 when the same is in its respective closed position, as is indicated in FIG. 4, wherein the sealing element 86 is shown operatively associated with the door jamb 88 and in particular, mounted on the interior side of a suitable door framing member 90, whereby to effectively preclude the passage of cold drafts, etc., around the longitudinally opposite ends of the door structure 10 and its associated door frame.

If desired, the door panels $P_o$ facing the exterior or outside of the associated garage structure, may have a plurality of decorative embossments or the like, representatively designated in FIGS. 1, 6 and 7 by the numeral 92. The embossments 92 are depicted as reverse raised panels and have a generally rectangular-shaped central depressed area 94, although the embossments 92 may be of any other suitable design or configuration consistent with the aesthetic appearance which is to be achieved. It is to be noted that by virtue of the identical construction of the panels $P_i$ and $P_o$ and their resultant interchangeability, one set of door panels, for example, $P_o$ may be provided with the aforementioned embossments 92, while the associated set of door panels $P_i$ may be provided with a different type of design, such as woodgraining or the like, whereby to provide for universality of installation, and also serve the secondary advantage of providing an aesthetically pleasant appearing interior surface on the subject door structure 10, as will be appreciated by those skilled in the art.

FIGS. 8–10 illustrate a slightly modified embodiment of the hinge reinforcement members hereinabove described and associated with each of the hinge assemblies 14. In particular, FIGS, 8–10 illustrate the construction of upper and lower hinge reinforcements 100 and 102 associated with the upper and lower longitudinal edges of each of the door sections 12. The members 100, 102 may be similar or identical to the aforedescribed members 60 and 62, respectively, insofar as comprising spaced parallel side portions 104 and 106, respectively, and laterally extending base or web portions 108, 110, respectively; however, the members 100, 102 associated with each of the hinge assemblies 14 differ from the aforedescribed members 60, 62, as follows.

The web portion 108 and 110 of the members 100, 102 are formed with a plurality of alternately facing, generally L-shaped deformable fingers 112 which prior to assembly, are originally disposed in a position shown in FIG. 10 and upon assembly, are adapted to be deformed downwardly to a position wherein the outer retaining lug portions 114 at the terminal ends of each of the fingers 112 moves into confining relationship with the return bend portion 32 and 44 at the upper and lower edges of the panels $P_i$ and $P_o$, as best seen in FIG. 8, whereby to cooperate in operatively securing the respective panels $P_i$ and $P_o$ together. The reinforcement members 100, 102 may additionally be secured to the panels $P_i$ and $P_o$, as by spot welding or the like or may be secured thereto by the same means in which the hinge sections 78, 80 of each of the hinge assemblies 14 are secured in place, as will be appreciated by those skilled in the art.

It will be seen from the foregoing that the present invention provides a novel building structure which is particularly, although not necessarily adapted for use as a sectional-type garage door. By virtue of the laminated construction between the inner core and outer or exterior metal panel members, a strong and highly energy efficient structure is provided which minimizes to the extreme, the tooling and attendant manufacturing expenses associated therewith. The baffle effect and thermal break achieved by the arrangement of the respective panel members $P_i$ and $P_o$ at the interconnection between the respective sections minimizes to the extreme the passage of cold drafts or the like between the sections and also minimizes the heat conduction directly therethrough by virtue of the fact that there is an air gap between the confronting edges of the panels $P_i$ and $P_o$ of each of the sections. Another feature of the present invention resides in the highly improved aesthetic appearance of the building structure of the present invention which is achieved by having the structural reinforcement members, i.e., hinge reinforcement members and end members, disposed interiorly of the panels $P_i$ and $P_o$, which arrangement provides the additional advantage of minimizing the difficulties in storage and transport of the respective door sections. Accordingly, the present invention will find considerable economies in production, will be easily installed and will have a long and effective operational life.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An energy efficient laminated building structure for a sectional-type door having a plurality of said structures, and hinges movably connecting adjacent structures and permitting rocking movement therebetween, comprising:

first and second spaced, elongated metal panel members of identical cross-sections shape, each panel member having a main surface and first and second side edges;

said first side edges of said panel members being formed to provide a recessed area and said second side edges of said panel members being formed to provide a tongue area, said tongue area being insertable in said recessed area of an adjacent structure to create a baffle effect for inhibiting the passage of air therebetween, while also providing a clearance between said tongue and recess areas sufficient to permit limited relative movement between adjacent structures;

each of said first side edges including a return bend portion adjacent said main surface, an inwardly projecting portion extending from said return bend portion and a reverse bend portion extending from said inwardly projecting portion;

each of said second side edges including an inwardly offset and inclined portion adjacent said main surface, a U-shaped portion extending from said inwardly offset and inclined portion, an inwardly projecting portion extending from said U-shaped portion and a reverse bend portion extending from said inwardly projecting portion a unitary expanded core fabricated of a heat insulating media interiorly disposed between and adhesively bonded to said panel members the reverse bend portions on the first side edges being spaced from each other, and the reverse bend portions on the second side edges being spaced from each other and together with said expanded core the said spaced reverse bend portions acting to prevent direct contact between the first and second panel members, a generally U-shaped end member secured to the interior edges of said panel members at each end thereof;

retainer means operatively associated with said reverse bend portion of said first and second side edges for securing said first and second panel members together along said first and second side edges; and reinforcement means of generally C-shaped cross-section, nestingly received and secured interiorly of said panel members along said first and second side edges, for reinforcing said panel members at said hinges said retainer means being characterized by a plurality of alternately facing generally L-shaped deformable fingers formed in said reinforcement means for confining said reverse bend portions of said first and second side edges.

* * * * *